US008602848B2

(12) United States Patent
Moon et al.

(10) Patent No.: US 8,602,848 B2
(45) Date of Patent: Dec. 10, 2013

(54) METHOD AND SYSTEM FOR POLISHING FLOAT GLASS

(75) Inventors: Won-Jae Moon, Seoul (KR); Hyung-Young Oh, Goyang-si (KR); Sang-Oeb Na, Seoul (KR)

(73) Assignee: LG Chem, Ltd. (KR)

( * ) Notice: Subject to any disclaimer, the term of this patent is extended or adjusted under 35 U.S.C. 154(b) by 476 days.

(21) Appl. No.: 12/900,086

(22) Filed: Oct. 7, 2010

(65) Prior Publication Data

US 2011/0086753 A1 Apr. 14, 2011

(30) Foreign Application Priority Data

Oct. 8, 2009 (KR) ..... 10-2009-0095706

(51) Int. Cl.
*B24B 7/24* (2006.01)

(52) U.S. Cl.
USPC ..... 451/288; 451/41

(58) Field of Classification Search
USPC ..... 415/119, 158, 159, 160, 41, 42, 446, 415/398, 397, 402; 451/119, 158, 159, 160, 451/41, 42, 446, 398, 397, 402, 259, 285, 451/287, 288
See application file for complete search history.

(56) References Cited

U.S. PATENT DOCUMENTS

| | | | | |
|---|---|---|---|---|
| 6,136,138 | A * | 10/2000 | Yagisawa | 156/345.12 |
| 6,179,695 | B1 * | 1/2001 | Takahashi et al. | 451/287 |
| 2002/0045410 | A1 * | 4/2002 | Sakurai et al. | 451/57 |
| 2003/0232574 | A1 | 12/2003 | Abrahamians et al. | |
| 2004/0072515 | A1 * | 4/2004 | Miyahara et al. | 451/285 |

FOREIGN PATENT DOCUMENTS

| | | | |
|---|---|---|---|
| JP | 60191750 | A | 9/1985 |
| JP | 64045566 | A | 2/1989 |
| JP | 01170556 | U | 12/1989 |
| JP | 06333891 | A | 12/1994 |
| JP | 2006116675 | A | 5/2006 |

* cited by examiner

*Primary Examiner* — Richard Crispino
*Assistant Examiner* — Yana Belyaev
(74) *Attorney, Agent, or Firm* — McKenna, Long & Aldridge, LLP

(57) ABSTRACT

A system for polishing a float glass used for liquid crystal displays includes a lower unit configured to rotate a float glass to be polished, a head assembly configured to be rotatable in contact with the float glass, and a moving unit configured to move the head assembly in a horizontal direction, wherein the head assembly includes at least two heads that are rotatable, respectively.

9 Claims, 6 Drawing Sheets

METHOD AND SYSTEM FOR POLISHING FLOAT GLASS

CROSS-REFERENCE TO RELATED APPLICATION

This application claims priority under 35 USC 119(a) to Korean Patent Application No. 10-2009-0095706 filed in Republic of Korea on Oct. 8, 2009, the entire contents of which are incorporated herein by reference.

BACKGROUND OF THE INVENTION

1. Field of the Invention

The present invention relates to system and method for polishing a float glass, and more particularly to system and method for polishing a float glass used for liquid crystal displays.

2. Description of the Related Art

Generally, it is very important that a glass (or, a glass pane) used for liquid crystal displays keeps its flatness to a certain level so as to accurately realize images of the liquid crystal display. Thus, fine waviness or unevenness existing on a surface of a float glass formed in a float manner should be removed.

Such a glass polishing process may be classified into so-called 'Oscar' type polishing in which glasses are individually polished one by one, and so-called 'inline' type polishing in which a series of glasses are successively polished. Also, the glass polishing process may be classified into 'single side polishing' in which only one surface of a glass is polished, and 'double side polishing' in which both surfaces of a glass are polished.

In a conventional glass polishing device, while a polishing plate (or, an upper plate) having a polishing pad installed thereto is moved in a horizontal direction and a polishing stage (or, a lower plate or a glass setting plate) having a glass located thereon is rotated, the glass is polished using a slurry freely falling down onto the polishing plate.

In recent, the size of a float glass is gradually increased to cope with the trend of enlargement of liquid crystal displays, and accordingly the sizes of an upper plate of the polishing plate and a lower plate of the polishing stage are increased. In this circumstance, in a conventional glass polishing device, linear velocities at various radii of the upper plate driven in contact with the float glass are different from each other, which causes a difference in the degree of polishing in a radial direction of the upper plate and results in making it difficult to keep overall polishing evenness of the float glass. In particularly, in case of a device for polishing a float glass with a larger size, since a moving range of the upper plate of the polishing plate is restricted, it is relatively difficult to keep evenness of polishing at edge portions (for example, about 20 to 30 cm) of a rectangular float glass to be polished. In addition, if the moving range of the polishing plate is set greater so as to polish edge portions of a float glass, it is hard to keep balance in a radial direction of the polishing plate, and other portions than corner portions of the float glass may be unnecessarily over-polished.

Meanwhile, a conventional glass polishing device applies a force to a float glass by means of self weight of the upper plate, or the polishing plate, so it is impossible to apply uniform force to the float glass over the entire area of the polishing plate. In this reason, evenness at every region of a float glass finally polished is not regular, which results in more frequent defects in the float glass. In particular, as the size of the polishing plate is increased (up to about 1,000 mm in diameter) due to the enlargement of liquid crystal displays, this problem becomes more serious. In other words, in the conventional art, the entire portion of the polishing plate contacted with a float glass does not press the float glass with the same force, but the force applied to the float glass is gradually decreased outwards from the center of the polishing plate, thereby making it difficult to ensure uniformity of the polishing process.

SUMMARY OF THE INVENTION

The present invention is designed to solve the problems of the prior art.

Therefore, the present invention is directed to providing system and method for polishing a float glass, which may improve overall polishing evenness by minimizing a difference in the degree of polishing at different radii of an upper part caused by different linear velocities at different radii of the rotating upper part, under the circumstance that the polishing system becomes greater in size to cope with the trend of sizing-up of a float glass.

In other words, the present invention is directed to providing system and method for polishing a float glass, which may improve polishing evenness by polishing a float glass through a head assembly in which a plurality of heads with smaller diameter are assembled to be within a circumference of a circle formed by a head (hereinafter, referred to as an imaginary head area) of a conventional upper plate (so-called 'a single head system).

In one aspect of the present invention, there is provided a system for polishing a float glass, which includes a lower unit configured to rotate a float glass to be polished; a head assembly configured to be rotatable in contact with the float glass; and a moving unit configured to move the head assembly in a horizontal direction, wherein the head assembly includes at least two heads that are rotatable.

Preferably, the at least two heads include two circular heads having a diameter as much as about a half of a diameter of an imaginary head area and disposed adjacent to each other.

Preferably, the at least two heads include a plurality of circular heads disposed to be substantially inscribed to a circumference of a circle formed by an imaginary head area.

Preferably, the system for polishing a float glass according to the present invention further includes a reciprocating mechanism for reciprocating the at least two heads at the same time.

Preferably, the reciprocating mechanism includes an actuator installed to a frame; a connection member connected to a shaft of the actuator; at least two support blocks installed to the frame to be disposed in correspondence with the at least two head, respectively; at least two moving blocks connected to the connection member and installed to be movable along the support blocks, respectively; and a second connection member installed between spindles of the heads and the moving blocks, respectively.

Preferably, the system for polishing a float glass according to the present invention further includes at least two rotating mechanisms for rotating the at least two heads, respectively.

Preferably, each of the at least two rotating mechanisms includes a driving source installed to a frame; a driving pulley installed to a rotary shaft of the driving source; a spline installed to a spindle of the head; a driven pulley coupled to the spline; and a belt connecting the driving pulley to the driven pulley.

Preferably, each of the at least two heads includes a fixed platter fixed to a spindle; a polishing platter installed to be movable with respect to the fixed platter; and a pressing member interposed between the fixed platter and the polishing platter to keep uniformity of pressure of the polishing patter, which is applied to the float glass.

Preferably, the pressing member includes a plurality of air springs installed between the fixed platter and the polishing platter.

Preferably, the air springs include at least two air spring groups arranged in a circular pattern around the spindle.

Preferably, the system for polishing a float glass according to the present invention further includes a slurry supply unit for supplying a slurry to the float glass.

In another aspect of the present invention, there is also provided a method for polishing a float glass, which includes contacting an upper plate with a float glass to be polished, which is rotated by a lower plate; and polishing the float glass by means of a slurry supplied between the upper plate and the float glass while rotating and horizontally moving the upper plate, wherein the upper plate includes at least two heads whose structures are substantially identical to each other, and wherein the method further comprises a step of operating the at least two heads at the same time.

Preferably, the method for polishing a float glass according to the present invention further includes a step of independently rotating the at least two heads.

Preferably, the method for polishing a float glass according to the present invention further includes a step of moving the at least two heads in a horizontal direction at the same time.

Preferably, the method for polishing a float glass according to the present invention further includes a step of polishing the float glass by means of rotation and horizontal movement of the at least two heads while not rotating the lower plate on which the float glass is disposed.

Preferably, the method for polishing a float glass according to the present invention further includes a step of polishing the float glass by means of rotation and horizontal movement of the at least two heads while rotating the lower plate on which the float glass is disposed.

The system and method for polishing a float glass according to the present invention give the following effects.

First, since the head assembly (or, the upper plate) is configured to have a plurality of heads, which has a reduced diameter as much as a half of a diameter of a single head employed in a conventional glass polishing system or are respectively inscribed to a circumference of a circle formed by a virtual single head area, it is possible to minimize a difference in the degree of polishing caused by different linear velocities at various radii of the upper plate and thus improve overall evenness of polishing.

Second, since the upper plate is rotated separately from the lower plate, it is possible to polish a float glass as desired regardless of rotational movement of the lower plate. In particular, it is possible to improve evenness of polishing at edge portions of a float glass, which were not easily or deficiently polished in the conventional art.

Third, since each head assembly may apply the same force to various portions of the polishing platter with respect to the fixed platter by means of a plurality of air springs and absorb vibration during the polishing work, it is possible to enhance evenness of the float glass.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, a glass setting plate for a glass polishing system according to a preferred embodiment of the present invention will be described in detail with reference to the accompanying drawings.

Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
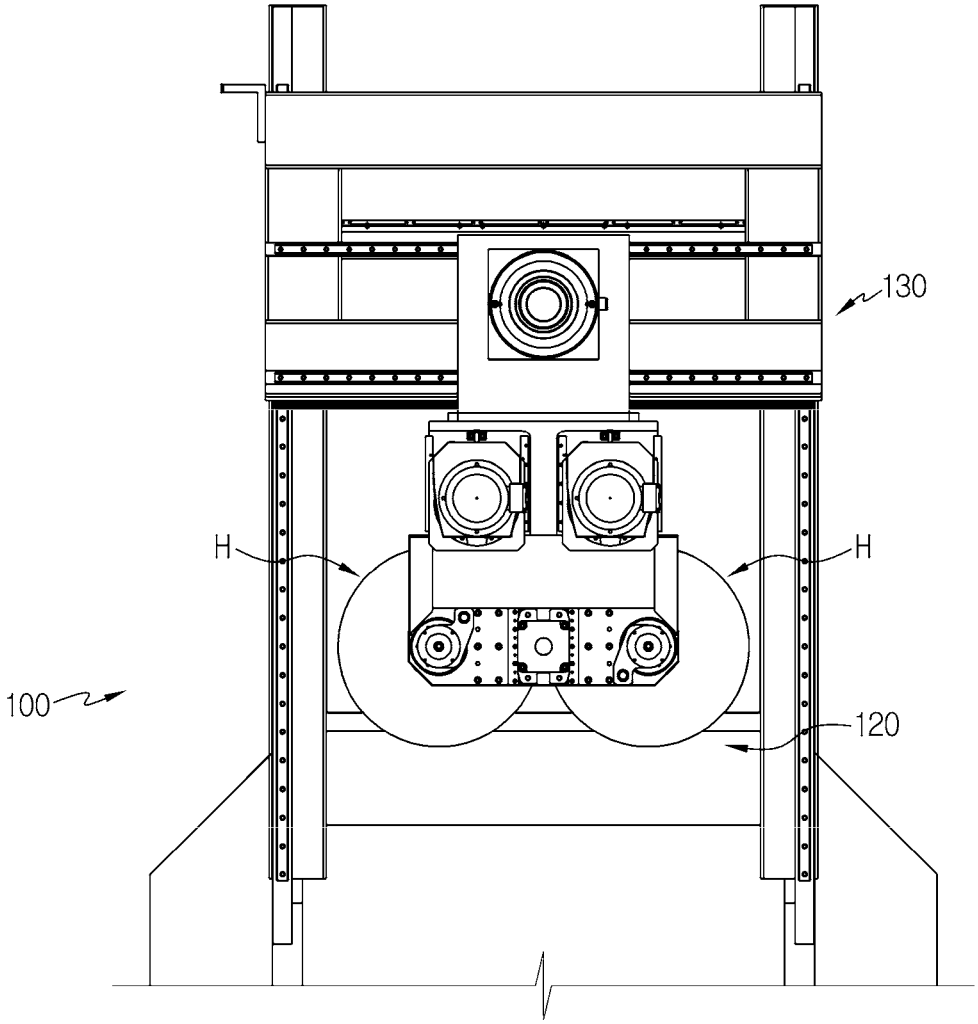
FIG. 1 is a plane view schematically showing a system for polishing a float glass according to a preferred embodiment of the present invention.
Figure 2:
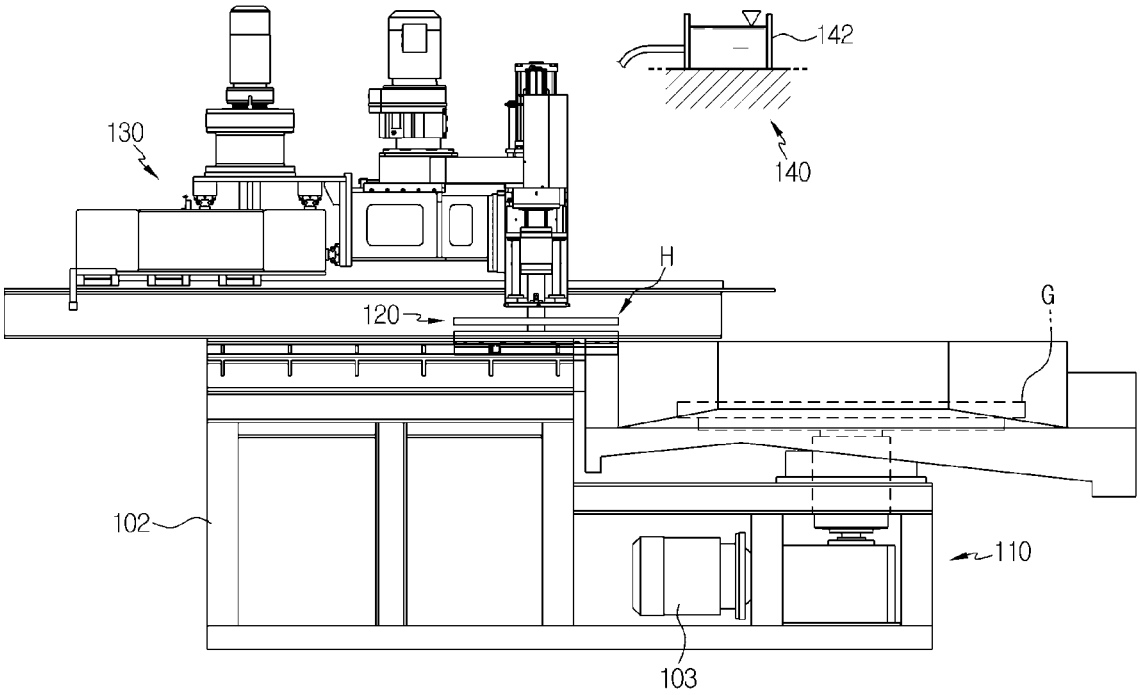
FIG. 2 is a left side view of FIG. 1.
Figure 3:
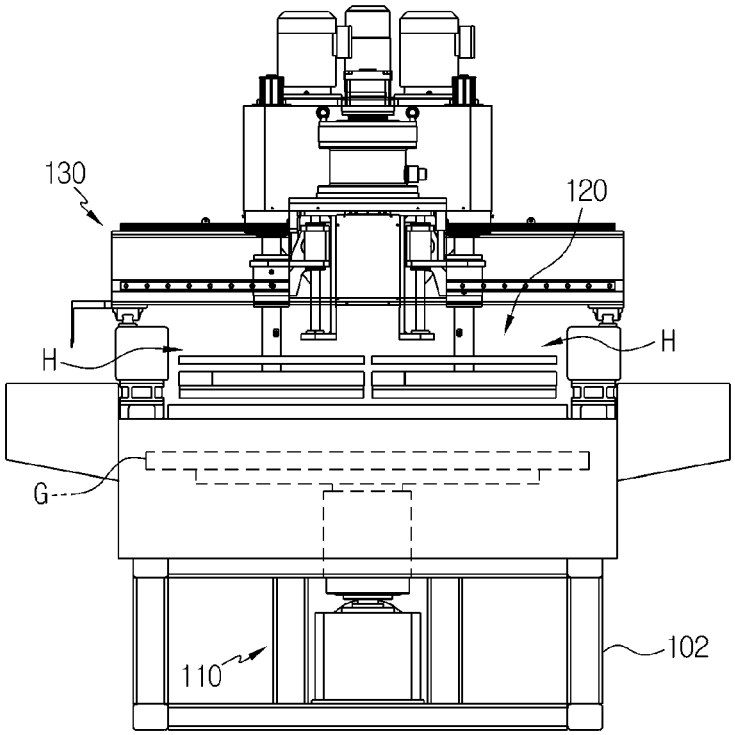
FIG. 3 is a front view of FIG. 1.
Figure 4:
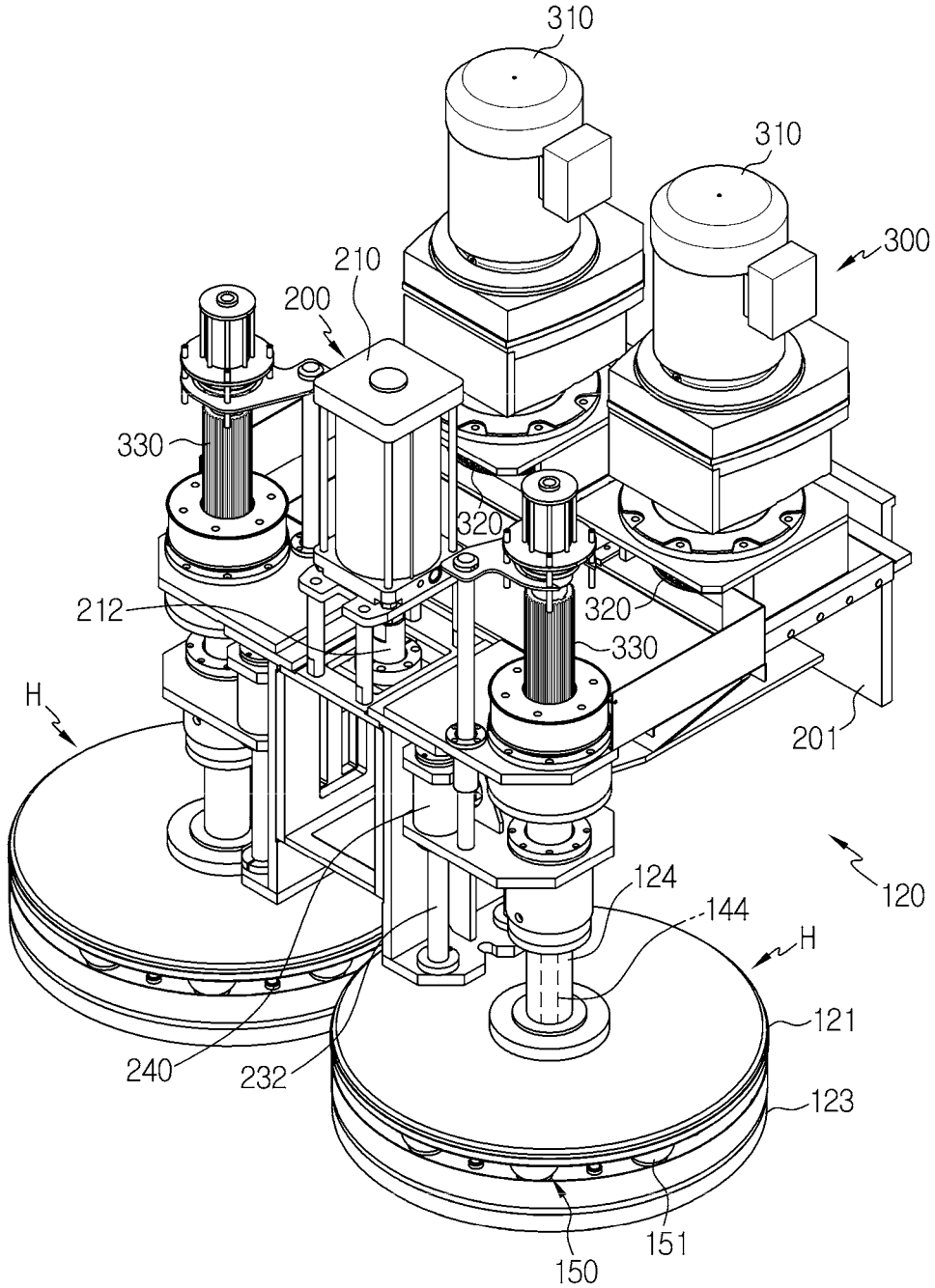
FIG. 4 is a perspective view showing only a head assembly employed in the system of FIGS. 1 to 3.

FIG. 1 is a plane view schematically showing a system for polishing a float glass according to a preferred embodiment of the present invention, FIG. 2 is a left side view of FIG. 1, FIG. 3 is a front view of FIG. 1, and FIG. 4 is a perspective view showing only a head assembly employed in the system of FIGS. 1 to 3.

Referring to FIGS. 1 to 4, a system 100 for polishing a float glass according to a preferred embodiment of the present invention is used for polishing one surface of a large float glass G having a length more than about 1,000 mm and thickness of about 0.3 to 1.1 mm such that the float glass G may have evenness needed for liquid crystal displays. Also, as an example, the polishing system 100 includes a lower unit 110 for holding a float glass G to be polished by means of absorption and then rotating the float glass G at a predetermined rotation speed, the lower unit 100 being also capable of supporting the float glass G; a pair of head assemblies 120 installed above the lower unit 110 and respectively having heads H to each of which a polishing pad 122 contactable with an upper surface (or, a surface to be polished) of the float glass G held by the lower unit 110 is attached; a moving unit 130 for moving the head assembles 120 in a horizontal direction; and a slurry supply unit 140 for receiving a slurry from a slurry supplier 142 and supplying the slurry to the surface to be polished of the float glass G through heads H of the head assemblies 120.

The heads H of the head assembly 120 are configured to independently rotate while moving along a predetermined trajectory in a horizontal direction by means of the moving unit 130. Also, the slurry supplied from the slurry supply unit 140 is uniformly spread over the entire surface to be polished of the float glass G through the heads H of the head assembly 120.

The moving unit 130 is used for moving the head assembly 120 in a horizontal direction, and it includes a stage, a guide and so on, which are commonly used in the art. A head frame 201 of the head assembly 120 is detachably installed to one side of the moving unit 130. The lower unit 110 may rotate by means of a motor 103 installed to a frame 102.

Thus, the polishing process of this embodiment may have several modes as follows.

(1) In a first mode, the float glass G is rotated due to the rotation of the lower unit 110 while the heads H of the head assembly 120 are rotated and also the head assembly 120 is horizontally moved (along a trajectory) by means of the moving unit 130.

(2) In a second mode, only the heads H are rotated and moved horizontally in a state that the float glass G is fixed to the lower unit 110 without operating the motor 103.

(3) In a third mode, as the lower unit 110 is rotated by means of the motor 103 and also the float glass G located thereon is rotated, the heads H contacted thereto are driven to horizontally move the head assembly 120.

Meanwhile, in case the float glass G is not rotated but fixed, it is possible to control the degree of polishing by adjusting a time that the heads H of the head assembly 120 stay on the float glass G. In particular, it is possible to improve the degree of polishing at edge portions of the float glass, which do not allow easy polishing.

Figure 5:
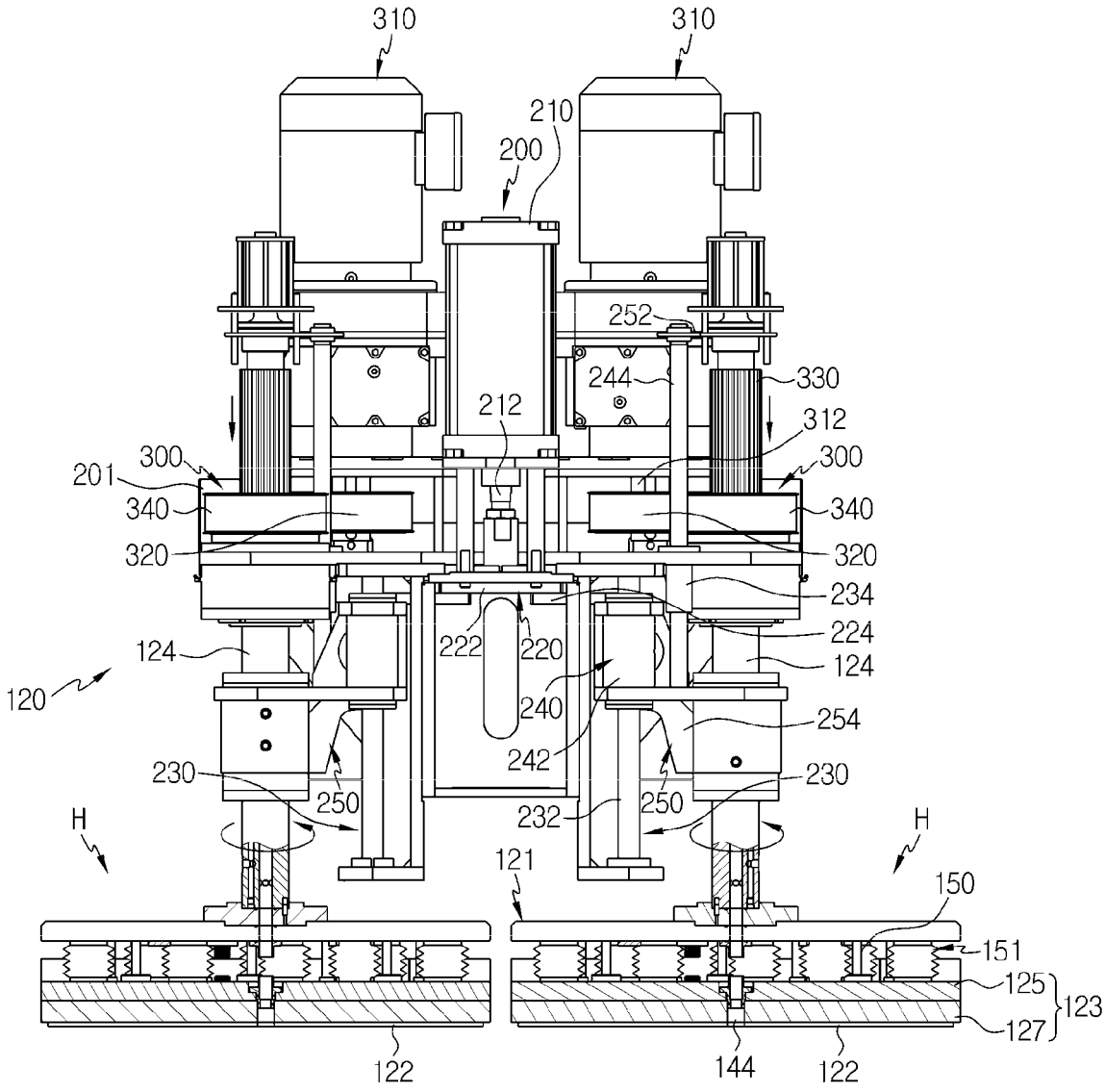
FIG. 5 is a schematic view showing configurations around the head assembly of FIG. 4.

FIG. 5 is a schematic view showing configurations around the head assembly of FIG. 4.

Referring to FIGS. 4 and 5, the system 100 for polishing a float glass according to a preferred embodiment of the present invention includes a reciprocating mechanism 200 for reciprocating the heads H of the head assembly 120 at the same time. The reciprocating mechanism 200 allows the heads H of the head assembly 120 to be in a descended state during a polishing work such that the polishing pad 122 of each head H may contact with and polish the surface to be polished of the float glass G while the float glass G is fixed on the lower unit 110, and the reciprocating mechanism 200 may return the heads H to original locations if the polishing work is completed or it is needed to interrupt the polishing work.

In a preferred embodiment, the reciprocating mechanism 200 includes one actuator 210 installed to the head frame 201, a connection member 220 connected to a shaft 212 of the actuator 210, a pair of support blocks 230 installed to the head frame 201 to be respectively located in correspondence with the head assemblies 120, a pair of moving blocks 240 connected to the connection member 220 and installed to be movable along the support blocks 230, and a pair of second connection members 250 respectively installed between spindles 124 of the head assemblies 120 and the moving blocks 240.

The actuator 210 preferably has a cylinder equipped with a rod-like shaft 212 that is reciprocated by pneumatic or oil pressure as an example. The connection member 220 includes a connection plate 222 connected and fixed to the shaft 212 of the actuator 210, and a pair of side plates 224 protruded from the connection plate 222 to both sides of the connection plate 222. Each support block 230 includes a support rod 232 and a support sleeve 234 installed to the head frame 201. Each of the moving blocks 240 includes a moving sleeve 242 coupled to an outer circumference of the support rod 232 to be movable along the support rod 232, and a moving rod 244 disposed to move through the support sleeve 234. The second connection member 250 includes an upper connection plate 252 connecting an upper end of the spindle 124 to an end of the moving sleeve 242, and a lower connection plate 254 connecting a lower portion of the spindle 124 to the moving sleeve 242.

The system 100 for polishing a float glass according to a preferred embodiment of the present invention includes a pair of rotating mechanisms 300 having the same configuration so as to individually rotate the heads H of each head assembly 120.

Each rotating mechanism 300 includes a driving source 310 installed to the head frame 201, a driving pulley 320 installed to a rotary shaft 312 of the driving source 310, a spline 330 installed to the spindle 124 of the head assembly 120, a driven pulley 340 coupled to the spline 330, and a belt (not shown) connecting the driving pulley 320 to the driven pulley 340.

The driving source 310 is used for rotating the heads H disposed below the spindle 124 at a predetermined rotating speed by rotating the spindle 124 of each head assembly 120, and an electric motor well known in the art is preferably used for the driving source 310.

The driving pulley 320 and the driven pulley 340 have a common pulley structure around which the belt may be installed. The driving pulley 320 and the driven pulley 340 are located and rotated on the same plane. The driven pulley 340 has an inner spline portion at its inner circumference such that the inner spline portion is engaged with an outer spline portion of the spline 330.

The spline 330 is elongated in a length direction of the spindle 124 of the head assembly 120. The spline 330 prevents the spindle 124 from interfering the rotating mechanism 300 when the spindle 124 moves so as to move the heads H of the head assembly 120 by means of the reciprocating mechanism 200 and at the same time transfers a rotating force of the driving source 310 to the spindle 124. Vertical reciprocation of the heads H of the reciprocating mechanism 200 is explained below in more detail. If the spindle 124 is vertically moved by means of the actuator 210, the spline 330 installed to the outer circumference of the spindle 124 is moved together. At this time, the outer spline portion of the spline 330 comes into contact with the inner spline portion of the driven pulley 340 and slid therein to be engaged with the driven pulley 340. Also, if the driving source 310 rotates the driving pulley 320 and transfers the rotating force to the driven pulley 340, the rotating force is transferred to the spline 330 through the outer spline portion engaged with the inner spline portion, thereby finally rotating the spindle 124 and also rotating the head H installed at a lower end of the same shaft.

Hereinafter, the head assembly according to a preferred embodiment of the present invention is explained in more detail. Components of the head assembly and their operating principles are disclosed in Korean Patent Application Nos. 10-2009-0019290, 10-2009-0019292 and 10-2009-0019293, filed on Mar. 6, 2009 by the applicant of this application and entitled "System and method for polishing a float glass", the entire contents of which are incorporated herein by reference.

The head H of the head assembly 120 includes a fixed platter 121 and a polishing platter 123, respectively configured as a disk shape as a whole. The polishing platter 123 is composed of a middle platter 125 and a separating platter 127. The fixed platter 121 is fixed to a lower end of the spindle 124, and the polishing platter 123 is spaced apart from the fixed platter 121 so as to be movable with respect to the fixed platter 121. The separating platter 127 is installed to be selectively separatable from the middle platter 125 in an absorption manner.

The slurry supplying unit 140 has a plurality of slurry supply paths 144 formed through the fixed platter 121, the middle platter 125 and the separating platter 127 so as to supply a slurry containing silica particles, as an example, from the slurry supplier 142.

In another embodiment of the present invention, the system 100 for polishing a float glass includes a pressing member 150 for uniformly keeping pressure at every portion of the head H of the head assembly 120, which is contacted with a float glass G that is rotated or fixed. The pressing member 150 is used for the polishing platter 123 having the polishing pad 122 to press the float glass G with substantially uniform pressure, and the pressing member 150 has a plurality of air springs 151 installed between the fixed platter 121 and the middle platter 125 of the polishing platter 123 and disposed with a predetermined pattern. The arrangement of the air springs 151 includes a first air spring group and a second air spring group concentrically disposed at a predetermined interval from the inside to the outside based on the spindle 124. Configuration and functions of the air springs are also disclosed in Korean Patent Application Nos. 10-2009-0019290, 10-2009-0019292 and 10-2009-0019293, filed on Mar. 6, 2009 by the applicant of this application and entitled "System and method for polishing a float glass", the entire contents of which are incorporated herein by reference.

Now, operations of the system for polishing a float glass according to a preferred embodiment of the present invention will be explained as follows.

First, a float glass G to be polished is attached to an upper surface of the lower unit 110 in a known manner (e.g., absorption), and then the motor 103 is operated to rotate a table 106. Meanwhile, the reciprocating mechanism 200 is operated to compress a lower surface of the polishing pad 122 of each head H of the head assembly 120 to a surface to be polished of the float glass G. Then, the actuator 210 is operated to move the connection member 220, and the movement of the connection member 220 makes the moving block 240 move along the support block 230. Also, as the moving block 240 moves, the spindle 124 is moved so that the spline 330 installed to the outer circumference of the spindle 124 is slid along the inner spline portion of the driven pulley 340, so the head H descends to make the polishing pad 122 come into contact with the float glass G.

Then, the heads H of the head assembly 120 are rotated based on the spindle 124 by means of the rotation of the lower unit 110, thereby making horizontal movements along a trajectory at the same time by means of the moving unit 130.

Meanwhile, if the rotating mechanism 300 is operated, a rotating force of the driving source 310 is transferred to the spindle 124 through the driving pulley 320, the belt, the driven pulley 340 and the spline 330, so each head H of the head assembly 120 may be rotated. In this case, the lower unit 110 may be rotated or not. In case the lower unit 110 is rotated, the heads H are preferably rotated in a direction opposite to a rotating direction of the float glass G.

If the slurry supply unit 140 is operated in a state that the polishing pad 122 is contacted with the float glass G as mentioned above, the slurry contained in the slurry supplier 142 is supplied through the slurry supply paths 144 formed through the fixed platter 121, the middle platter 125 and the separating platter 127 so that the slurry is uniformly applied to the surface to be polished of the float glass G. The slurry supply unit 140 may supply the slurry continuously during the entire polishing process, and the used slurry may be preferably filtered and retrieved to the slurry supplier 142 for circulation.

In addition, during this polishing process, the pressing member 150 is operated such that all of the heads H of the head assembly 120 may continuously apply uniform pressure to the float glass G. If the pressing member 150 is operated, an air of an air supplier (not shown) is supplied through the inside of the spindle 124 and a rotary joint, and this air expands each air spring 151 through each air supply tube. Then, the polishing platter 123 is moved with respect to the fixed platter 121, and pressures at every air spring 151 become uniform, so it is possible to always apply uniform pressure to the surface to be polished of the float glass G though the head assembly 120 is moved in a horizontal direction by the moving unit 130. Here, the pressing member 150 may be operated before the polishing pad 122 of the head H comes into contact with the surface to be polished of the float glass G, or when the polishing process is initiated after the polishing pad 122 is contacted with the float glass G. Meanwhile, the pressing operation of the pressing member 150 may be controlled in accordance with a set pressure during the polishing process.

In the system 100 for polishing a float glass according to the above embodiment, dimension of the head H of each head assembly 120 (diameter in case the head has a disk shape) is smaller than dimension (length or width) of the rectangular float glass G to be polished, and the diameter of the head H is about a half (½) of a diameter of a conventional single head. In other words, the diameter of the so-called dual head H is respectively about a half (½) of a diameter of a single head.

Figure 6A:
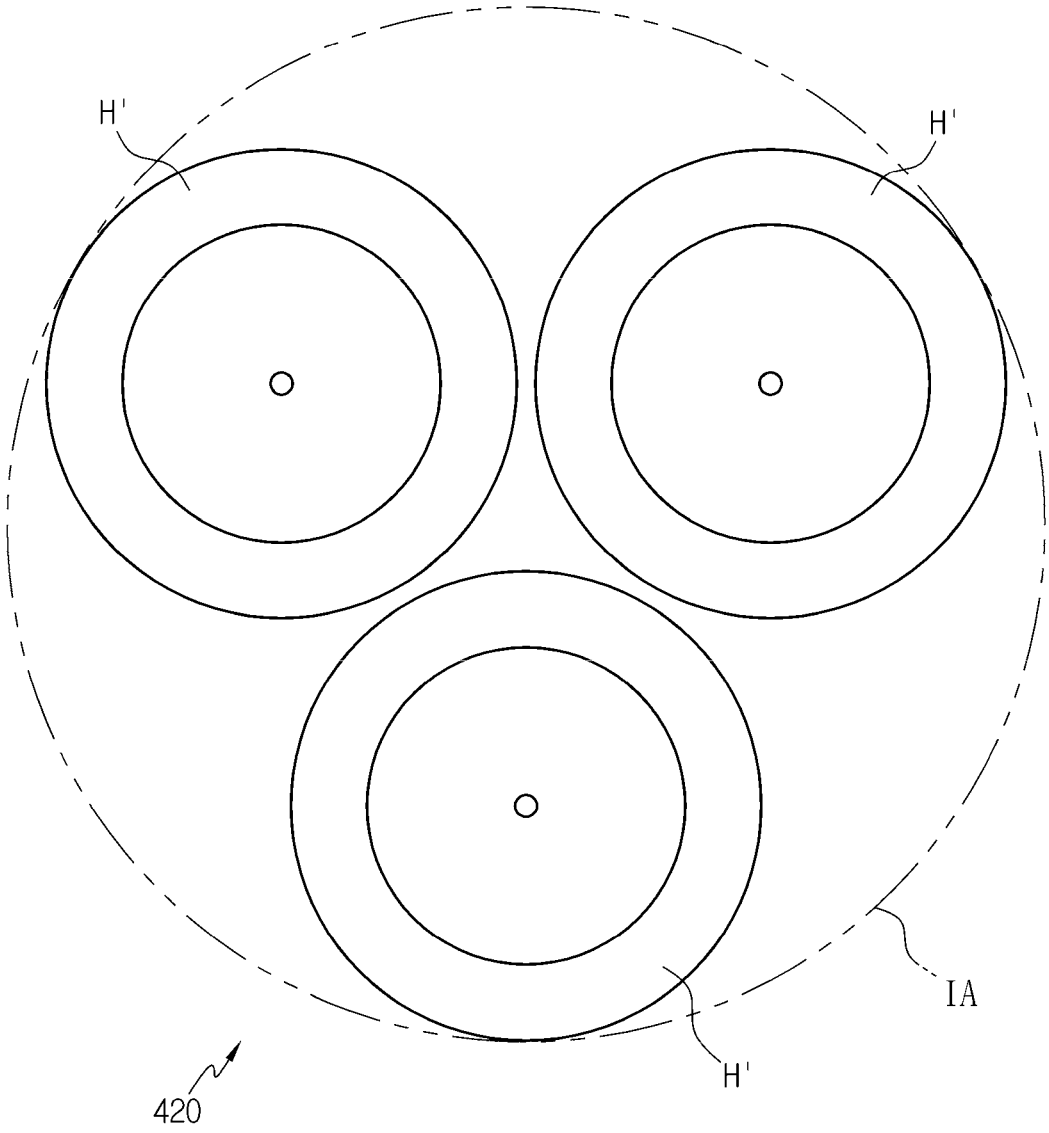
FIGS. 6A and 6B are schematic views showing heads of a head assembly according to another embodiment of the present invention.
Figure 6B:
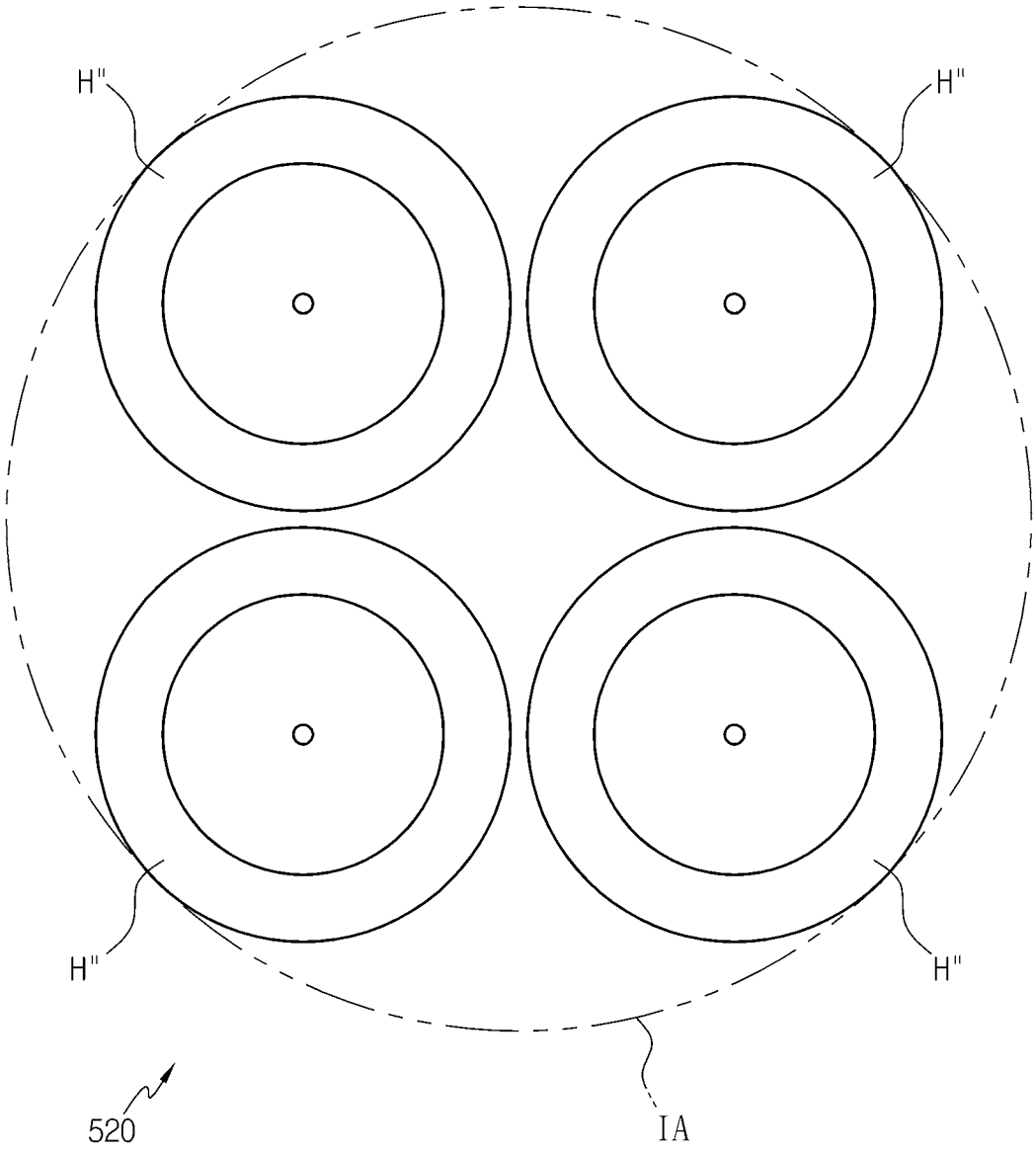

As alternatives, as shown in FIGS. 6A and 6B, head assemblies 420 and 520 may have three heads H' or four heads H". In these embodiments, the heads H' and H" are inscribed to a circumference of a circle formed by an imaginary single head area IA and disposed close to each other so as to be substantially circumscribed with each other. Thus, in case the head assembly 420 has three heads H' as shown in FIG. 6A, centers of three heads H' are disposed as a triangle, while, in case the head assembly 520 has four heads H" as shown in FIG. 6B, centers of four heads H" are disposed as a square.

In the above embodiments, as the number of heads H and H' and H" is increased, a diameter of each head is decreased as much, and an area of one head assembly 120, 420 and 520 in which heads H, H' and H" are assembled is substantially identical to the imaginary single head area IA. In case the head assembly 120, 420 and 520 is composed of a plurality of heads H, H' and H" with relatively reduced diameter as mentioned above, a horizontal movement range of the head assembly 120, 420 and 520 for polishing edge portions of a float glass G may be increased further in comparison to conventional glass polishing devices. In addition, it is also possible to polish an edge portion of the float glass G by using only one of the heads H, H' and H" of the head assembly 120, 420 and 520, and thus unbalancing problems of a conventional single head may be solved.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A system for polishing a float glass, comprising:

a lower unit configured to rotate a float glass to be polished;

a head assembly configured to be rotatable in contact with the float glass, the head assembly including at least two heads that are rotatable, respectively;

a moving unit configured to move the head assembly in a horizontal direction; and a reciprocating mechanism for reciprocating the at least two heads at the same time, wherein the reciprocating mechanism includes:

an actuator installed to a frame;

a connection member connected to a shaft of the actuator;

at least two support blocks installed to the frame to be disposed in correspondence with the at least two heads, respectively;

at least two moving blocks connected to the connection member and installed to be movable along the support blocks, respectively; and a second connection member installed between spindles of the heads and the moving blocks, respectively.

2. The system for polishing a float glass according to claim 1, wherein the at least two heads include two circular heads having a diameter as much as about a half of a diameter of an imaginary head area and disposed adjacent to each other.

3. The system for polishing a float glass according to claim 1, wherein the at least two heads include a plurality of circular heads disposed to be substantially inscribed to a circumference of a circle formed by an imaginary head area.

4. The system for polishing a float glass according to claim 1, further comprising at least two rotating mechanisms for rotating the at least two heads, respectively.

5. The system for polishing a float glass according to claim 4, wherein each of the at least two rotating mechanisms includes:

a driving source installed to a frame;

a driving pulley installed to a rotary shaft of the driving source;

a spline installed to a spindle of the head;

a driven pulley coupled to the spline; and a belt connecting the driving pulley to the driven pulley.

6. The system for polishing a float glass according to claim 1, wherein each of the at least two heads includes:

a fixed platter fixed to a spindle;

a polishing platter installed to be movable with respect to the fixed platter; and a pressing member interposed between the fixed platter and the polishing platter to keep uniformity of pressure of the polishing patter, which is applied to the float glass.

7. The system for polishing a float glass according to claim 6, wherein the pressing member includes a plurality of air springs installed between the fixed platter and the polishing platter.

8. The system for polishing a float glass according to claim 7, wherein the air springs include at least two air spring groups arranged in a circular pattern around the spindle.

9. The system for polishing a float glass according to claim 1, further comprising a slurry supply unit for supplying a slurry to the float glass.

* * * * *